US009300063B2

(12) United States Patent
Tatzel et al.

(10) Patent No.: US 9,300,063 B2
(45) Date of Patent: Mar. 29, 2016

(54) CONNECTING MEMBER

(71) Applicant: Rosenberger Hochfrequenztechnik GmbH & Co. KG, Fridolfing (DE)

(72) Inventors: Frank Tatzel, Ostermiething (AT); Georg Schiele, Waging am See (DE); Hauke Schütt, Bünsdorf (DE)

(73) Assignee: Rosenberger Hochfrequenztechnik GmbH & Co. KG, Fridolfing (DE)

( * ) Notice: Subject to any disclaimer, the term of this patent is extended or adjusted under 35 U.S.C. 154(b) by 0 days.

(21) Appl. No.: 14/358,993

(22) PCT Filed: Oct. 26, 2012

(86) PCT No.: PCT/EP2012/004493

§ 371 (c)(1),
(2) Date: May 16, 2014

(87) PCT Pub. No.: WO2013/072011

PCT Pub. Date: May 23, 2013

(65) Prior Publication Data

US 2014/0329421 A1 Nov. 6, 2014

(30) Foreign Application Priority Data

Nov. 18, 2011 (DE) ..... 20 2011 108 052 U

(51) Int. Cl.

| | |
|---|---|
| ***H01R 12/00*** | (2006.01) |
| ***H01R 12/70*** | (2011.01) |
| ***H01R 12/71*** | (2011.01) |
| ***H01R 12/73*** | (2011.01) |
| ***H01R 13/17*** | (2006.01) |
| *H01R 4/48* | (2006.01) |
| *H01R 12/52* | (2011.01) |
| *H01R 24/50* | (2011.01) |
| *H01R 103/00* | (2006.01) |

(52) U.S. Cl.

CPC ..... *H01R 12/7082* (2013.01); *H01R 12/712* (2013.01); *H01R 12/714* (2013.01); *H01R 12/732* (2013.01); *H01R 13/17* (2013.01); *H01R 4/48* (2013.01); *H01R 12/52* (2013.01); *H01R 24/50* (2013.01); *H01R 2103/00* (2013.01)

(58) Field of Classification Search

CPC .. H01R 9/096; H01R 23/722; H01R 13/2421; H01R 13/2428

USPC ..... 439/66, 65, 700

See application file for complete search history.

(56) References Cited

U.S. PATENT DOCUMENTS

| | | | | |
|---|---|---|---|---|
| 5,174,763 | A | 12/1992 | Wilson | |
| 5,192,213 | A | 3/1993 | Kosugi et al. | |
| 5,380,211 | A * | 1/1995 | Kawaguchi | H01R 4/30 439/581 |
| 6,079,986 | A * | 6/2000 | Beshears | H01R 9/096 439/581 |
| 6,758,680 | B2 * | 7/2004 | Duquerroy | H01R 24/50 439/63 |
| 6,835,095 | B2 * | 12/2004 | Chen | H01R 9/05 439/578 |
| 7,393,214 | B2 * | 7/2008 | DiStefano | H01R 13/2407 439/66 |
| 7,416,418 | B2 * | 8/2008 | Berthet | H01R 24/50 439/63 |
| 7,491,069 | B1 | 2/2009 | Stefano | |
| 7,972,173 | B1 * | 7/2011 | Hyzin et al. | 439/578 |
| 8,690,602 | B2 * | 4/2014 | Flaherty, IV | 439/578 |
| 2005/0026512 | A1 | 2/2005 | Seidler | |
| 2007/0269999 | A1 | 11/2007 | Stefano | |
| 2011/0021041 | A1 | 1/2011 | Galloway | |

* cited by examiner

*Primary Examiner* — Abdullah Riyami
*Assistant Examiner* — Thang Nguyen
(74) *Attorney, Agent, or Firm* — DeLio, Peterson & Curcio, LLC; Robert Curcio

(57) ABSTRACT

A connecting member for the electrically conductive connection of two components, having a (first) conductor which comprises a tubular shell which has at least one opening to reduce axial stiffness.

13 Claims, 2 Drawing Sheets

CONNECTING MEMBER

BACKGROUND OF THE INVENTION

1. Field of the Invention

The invention relates to a connecting member for the electrically conductive connection of two components, and in particular to a connecting member by which radio-frequency signals can be transmitted between two components, and in particular two printed circuit boards, with the greatest possible freedom from losses.

2. Description of Related Art

In the case of connecting members of this kind, it is necessary for them to ensure that the radio-frequency signals are transmitted with the greatest possible freedom from losses even within a defined range of tolerances on the parallelism of the two printed circuit boards and on the distance between them. Further requirements to be met by such connecting members lie in the areas of inexpensive manufacture and easy assembly. Also, the axial and radial dimensions of the connecting member need to be kept as small as possible.

What are used at the moment are chiefly connecting members of this kind of two designs.

On the one hand, a connection is made between two printed circuit boards by means of two co-axial plug-in connectors which are solidly connected to the printed circuit boards and an adapter, the so-called "bullet", which connects the two co-axial plug-in connectors. This adapter allows axial and radial tolerances to be compensated for and also allows tolerances on parallelism to be compensated for. Typical co-axial plug-in connectors used for this purpose are SMP connectors, mini-SMP connectors and FMC connectors.

Alternatively, electric connections are also made between two printed circuit boards by means of spring-loaded contact pins, so-called Pogo pins, of single-conductor and/or multi-conductor construction. Spring-loaded contact pins of this kind comprise a sleeve and a head which is partly guided within the sleeve plus a coil spring which is supported between the head and the sleeve. The properties with respect to resilient force and solid height which the coil spring is required to have call for springs of relatively great length, which have a commensurate adverse effect on the overall axial height of the spring-loaded contact pins. The use of spring-loaded contact pins of single-conductor construction also has the disadvantage that they have to be laid out in a particular pattern to act as signal and ground pins if satisfactory electrical performance is to be achieved. Multi-conductors on the other hand are prone to faults and costly due to their complicated construction.

SUMMARY OF THE INVENTION

Taking the above prior art as a point of departure, the object underlying the invention was to specify an improved connecting member for the electrical connection of two components. In particular, although having properties which compensated for tolerances, the connecting member was to be distinguished by inexpensive manufacture, construction which was simple and hence not at risk of errors, and/or easy assembly.

This object is achieved by virtue of the subject matter of the independent claims. Advantageous embodiments of the connecting member according to the invention form the subject matter of the dependent claims and can be seen from the description of the invention which follows.

Still other objects and advantages of the invention will in part be obvious and will in part be apparent from the specification.

The above and other objects, which will be apparent to those skilled in the art, are achieved in the present invention which is directed to a co-axial connecting member comprising a center conductor, an outer conductor, and an insulating member arranged between the center conductor and the outer conductor, for the electrically conductive connection of two components and for transmitting radio-frequency signals between the two components, wherein the outer conductor includes a first conductor having a tubular shell which has at least one opening to reduce axial stiffness, the outer conductor including, as well as the first conductor, a second conductor which is likewise of a tubular form, the first conductor being in electrically conductive contact with the second conductor, which electrically conductive contact is also axially mobile in relation to a portion of the first conductor, the second conductor being solidly connected to the first conductor over a portion. The opening preferably follows a helical path.

The co-axial connecting member includes at least two openings following helical paths which follow paths towards one another starting from the two ends of the shell.

The shell may include, at at least one end, resilient tabs which follow an oblique path relative to the longitudinal axis of the shell.

The shell may further include, at at least one end, a supporting surface which is larger than the cross-sectional area of the wall of the shell. The supporting surface preferably takes the form of an end of the shell which is folded round.

A second conductor may include a solid tubular shell.

The center conductor may include a spring-loaded contact pin.

The insulating member is preferably solidly connected to the center conductor and to a portion of the outer conductor.

BRIEF DESCRIPTION OF THE DRAWINGS

The features of the invention believed to be novel and the elements characteristic of the invention are set forth with particularity in the appended claims. The figures are for illustration purposes only and are not drawn to scale. The invention itself, however, both as to organization and method of operation, may best be understood by reference to the detailed description which follows taken in conjunction with the accompanying drawings in which:

DESCRIPTION OF THE PREFERRED EMBODIMENT(S)

Figure 1:
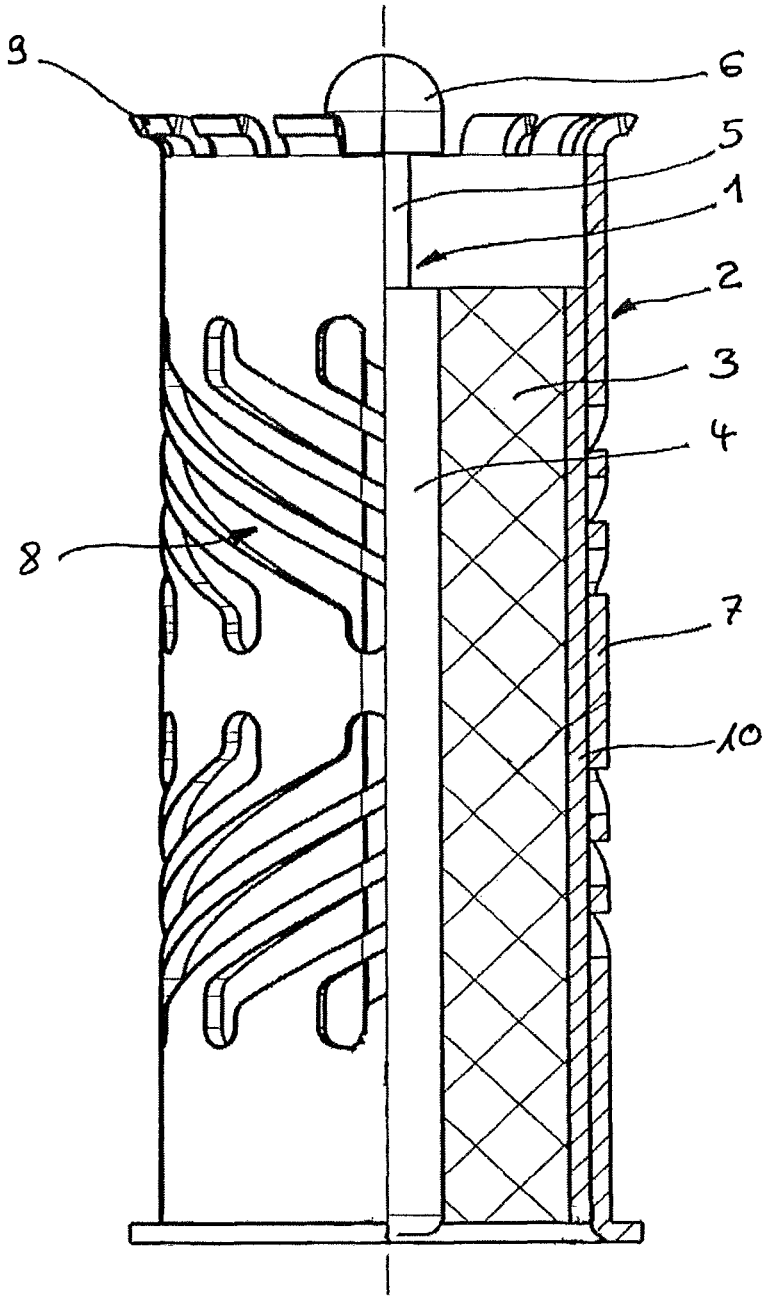
FIG. 1 is a view from the side, partly in section, of a connecting member according to the invention.

In describing the preferred embodiment of the present invention, reference will be made herein to FIGS. 1-3 of the drawings in which like numerals refer to like features of the invention.

The concept underlying the invention is to make the electrical connection between two components by means of a conductor of the simplest possible, and preferably one-piece, construction, and to bring about a compensation for tolerances on the positions of the two components to be connected by a deformation of this conductor due to its structural design.

What is used for this purpose in accordance with the invention is a conductor which comprises a tubular shell which has at least one opening to reduce the axial stiffness of the shell. The axial stiffness of the shell is so low in this case that the forces which occur when the two components are fitted cause a deformation of the shell in the axial direction which is required due in particular to tolerances on the positions of these two components.

An easy, inexpensive and effective possible way of reducing the axial stiffness of the tubular shell is to incorporate therein (at least) one opening which follows a helical path.

What is meant by a "helical path" in accordance with the invention is a path followed by the opening (referred to the points at which the opening begins and ends) which extends both in the axial and in the circumferential direction of the shell.

A particularly preferred embodiment of a connecting member of this kind according to the invention may make provision for there to be provided at least two such openings following helical paths which follow paths towards one another starting from the two ends of the shell. Provision may preferably be made in this case for each of these at least two openings following helical paths to extend for only a maximum of half the axial length of the shell and for them not to pass through one another.

As a particular preference, a plurality of openings may be provided which preferably follow parallel and/or helical paths. What may be provided in this case are in particular a first group of openings following helical paths and a second group of openings following helical paths, the openings forming the two groups following paths towards one another starting from the two ends of the shell. An embodiment of this kind has the additional advantage that an axial deformation of the conductor which, when there is an opening following a helical path, will try to cause a relative rotation of those portions of the shell which are separated by the helical opening, can be restricted to a region of the shell which is arranged between the two (groups of) openings which follow helical paths towards one another. It can thus be ensured that the two ends of the shell, which are intended to make contact with the two components, remain largely free of torsional stresses caused by the axial deformation.

In an embodiment of connecting member according to the invention which is, moreover, preferred, provision is made for the shell to be formed to have, at (at least) one end, resilient tabs which follow an oblique path relative to the longitudinal axis of the shell (taking as a reference the line connecting the points at which the given resilient tab begins and ends). By means of these resilient tabs, compensation can advantageously take place for tolerances on the parallelism of the two surfaces which are to be connected together of the components. At least within certain limits, resilient tabs of this kind also make possible a certain positional compensation in relation to the two components in the axial and radial directions (taking as a reference the shell of the conductor).

In an embodiment which is, moreover, preferred, the shell has, at at least one end, a supporting surface which is larger than the cross-sectional area of the wall of the shell. An enlarged supporting surface of this kind simplifies the making of a reliable connection with the component or components.

An inexpensive possible way of designing an enlarged supporting surface of this kind may make provision for it to take the form of an end of the shell which is folded round (preferably through 90°).

To ensure particularly good transmission characteristics for radio-frequency signals in particular through the conductor which is characterized by one or a plurality of openings, provision may preferably be made for this conductor to be in electrically conductive contact with a second conductor, which electrically conductive contact is also (at least in relation to a portion of the first conductor) mobile. This contact between the first and the second conductors may be provided in particular in that portion of the first conductor in which there are the openings introduced into the shell thereof. The second conductor thus assists the first conductor in transmitting electrical energy or signals and in particular radio-frequency signals, with moreover the deformation according to the invention of the first conductor which aims to compensate for tolerances on the positions of the two components being ensured by the at least partial axial mobility.

Provision may preferably be made in this case for the second conductor to have a solid tubular shell to make possible good transmission of, in particular, radio-frequency signals.

In a preferred embodiment of connecting member according to the invention, provision is made for the conductor or conductors to be provided in the form of outer conductors of a co-axial connecting member, which thus surround a further conductor (center conductor). This center conductor may preferably take the known form of a spring-loaded contact pin and may thus comprise a sleeve, a plunger which is partly guided within the sleeve, and a spring member which is supported between the plunger and the sleeve. Spring-loaded contact pins of this kind are notable for having good transmission characteristics particularly for radio-frequency signals and also for insensitivity to tolerances on the positions of the components to be connected together. Tolerances on the distance from one another of the two components are in fact compensated for by the possibility of a displacement of the plunger in the sleeve. The spring member ensures in this case that there is an adequate force pressing the plunger against the adjoining component.

An insulating member is preferably arranged between the outer conductor and the center conductor. To give a unit which can be handled satisfactorily, this insulating member may preferably be solidly connected to the center conductor and to at least a portion of the outer conductor. The possibility also exists in this case of the insulating member being solidly connected to the whole of the outer conductor, provided the latter has a relatively low modulus of elasticity and thus does not hamper the axial deformation of the outer conductor for which provision is made in accordance with the invention, or does not do so to any substantial degree.

The invention will be explained in detail below by reference to an embodiment which is shown in the drawings.

Figure 2:
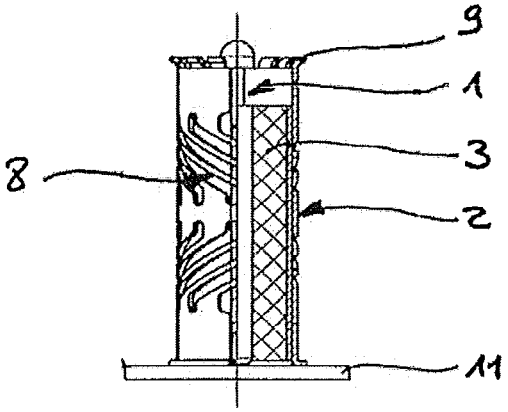
FIGS. 2 and 3 show the connecting member shown in FIG. 1 in combination with two printed circuit boards to be connected together electrically.
Figure 3:
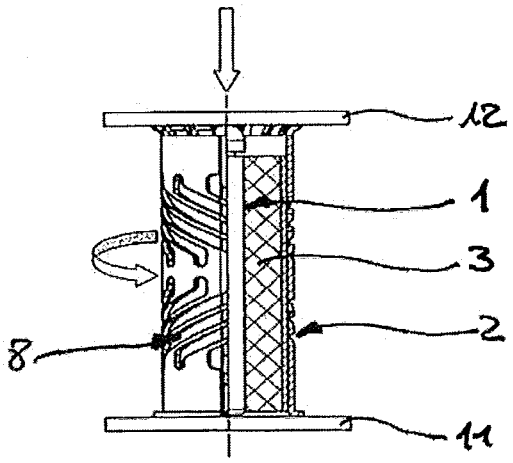

The connecting member shown in FIGS. 1 to 3 comprises a center conductor 1, an outer conductor 2 and an insulating member 3 which is arranged between the center conductor 1 and outer conductor 2. The center conductor 1 is in the form of a conventional spring-loaded contact pin, i.e. it comprises a sleeve 4 and a plunger which is partly guided within the sleeve to be movable and which has a plunger stem 5 and a head 6 having a spherical contact surface. Arranged inside the sleeve 4 is a coil spring (not shown) which is supported between the plunger and the floor of the sleeve 4.

The outer conductor 2 comprises a first conductor 7 having a tubular shell into which a plurality of openings 8 following helical paths has been introduced. These helical openings 8 are divided into two groups of which one starts from the end which is shown at the top in FIG. 1 and extends to a point shortly before the (axial) center of the shell. The second group starts from the end which is shown at the bottom in FIG. 1 and likewise extends to a point shortly before the (axial) center of the shell. The helical openings 8 have a part which follows a diagonal path and terminal portions which follow an axial path. All the parts of the helical openings 8 which made up a group follow paths which are parallel to one another.

The end of the shell which is shown at the bottom in FIG. 1 is folded round through 90°, thus forming a supporting surface which is larger than the cross-sectional area of the wall of the shell. The end of the shell which is shown at the top in FIG. 1 is bounded by a plurality of resilient tabs 9 which are formed to follow a path which is curved (through 90°), thus pointing outwards radially. The free end portions of the resilient tabs 9 form a plane of support.

As well as the first conductor 7, the outer conductor 2 also comprises a second conductor 10, which is likewise tubular and is of the same length as the insulating member 3 and is solidly connected (e.g. adhesively bonded) thereto. The shell of the second conductor 10 is solid and thus does not have any openings A solid connection between the first conductor 7 and the second conductor 10 is provided in the portion between the end shown at the bottom in FIG. 1 and the beginning of the openings 8 in the shell of the first conductor 7. All the components of the connecting member are thus solidly connected together, relative movement of the part of the first conductor 7 which is shown at the top in FIG. 1 nevertheless being relative to the second conductor 10.

To connect two printed circuit boards for transmitting radio-frequency signals by means of the connecting member according to the invention, the connecting member is first solidly connected to a first printed circuit board 11 by the folded-round bottom end (see FIG. 2). The second printed circuit board 12 is then fitted, which thus presses against the top end of the connecting member with a defined compressive applying force. Because of tolerances on the positions of the two printed circuits boards 11, 12, this compressive applying force may vary. The pressing of the second printed circuit board 12 against the connecting member on the one hand causes a displacement of the plunger of the center conductor 1 in opposition to the force from the coil spring. The spring-loading which is produced in this way ensures that the head 6 of the center conductor 1 makes secure contact with the corresponding point for contact on the printed circuit board 12.

The pressing down of the upper printed circuit board 12 is also responsible for an at least slight deformation of the elastically deflectable resilient tabs 9. This is the result simply of the overall length of the first conductor 7 of the outer conductor 2 being of a size such that it is slightly greater than the maximum distance between the two printed circuit boards 11, 12 which is allowed by the tolerances. Even though the resilient tabs 9 also allow tolerances on the distance from one another of the two printed circuit boards to be compensated for, their particular object is to compensate for tolerances on the parallelism of the contact surfaces of the printed circuit boards 11, 12 which are to be connected together.

The design according to the invention of the shell of the first conductor 7 is responsible in particular for compensating for tolerances on the distance from one another of the two printed circuit boards 11, 12. Because of the openings 8 following helical paths in the shell, the axial stiffness of the latter is so low that it is deformed as much as is required between the two printed circuit boards 11, 12. The actual laying-out of the helical openings in two groups which follow paths towards one another has the advantage in this case that the axial deformation of the first conductor 7 merely leads to a rotation of the central region of the shell which separates the two groups of openings 8 from one another (see FIG. 3). What can be achieved in this way is that the points at which the first Conductor 7 is connected to the two printed circuit boards 11, 12 remain substantially free of torsional forces.

While the present invention has been particularly described, in conjunction with a specific preferred embodiment, it is evident that many alternatives, modifications and variations will be apparent to those skilled in the art in light of the foregoing description. It is therefore contemplated that the appended claims will embrace any such alternatives, modifications and variations as falling within the true scope and spirit of the present invention.

Thus, having described the invention, what is claimed is:

1. A co-axial connecting member configured to connect two printed circuit boards for transmitting radio-frequency signals comprising a center conductor, an outer conductor, and an insulating member arranged between the center conductor and the outer conductor, for the electrically conductive connection of two components and for transmitting radio-frequency signals between the two components, wherein the outer conductor includes a first conductor having a tubular shell which has at least one opening to reduce axial stiffness, the outer conductor including, as well as the first conductor, a second conductor which is likewise of a tubular form, the first conductor being in electrically conductive contact with the second conductor, which electrically conductive contact is also axially mobile in relation to a portion of the first conductor, the second conductor being solidly connected to the first conductor over a portion, wherein said contact between the first and the second conductors is provided in particular in a portion of the first conductor in which are introduced the openings into the shell.

2. The co-axial connecting member of claim 1, wherein the opening follows a helical path.

3. The co-axial connecting member of claim 2, including at least two openings following helical paths which follow paths towards one another starting from the two ends of the shell.

4. The co-axial connecting member of claim 1, wherein the shell includes, at least one end, resilient tabs which follow an oblique path relative to the longitudinal axis of the shell.

5. The co-axial connecting member of claim 1, wherein the shell includes, at least one end, a supporting surface which is larger than the cross-sectional area of the wall of the shell.

6. The co-axial connecting member of claim 5, wherein the supporting surface takes the form of an end of the shell which is folded round.

7. The co-axial connecting member of claim 1, wherein the second conductor includes a solid tubular shell.

8. The co-axial connecting member of claim 1, wherein the center conductor includes a spring-loaded contact pin.

9. The co-axial connecting member of claim 1, wherein the insulating member is solidly connected to the center conductor and to a portion of the outer conductor.

10. The co-axial connecting member of claim 3, wherein the shell includes, at least one end, resilient tabs which follow an oblique path relative to the longitudinal axis of the shell.

11. The co-axial connecting member of claim 4, wherein the shell includes, at least one end, a supporting surface which is larger than the cross-sectional area of the wall of the shell.

12. The co-axial connecting member of claim 10, wherein the shell includes, at least one end, a supporting surface which is larger than the cross-sectional area of the wall of the shell.

13. The co-axial connecting member of claim 12, wherein the supporting surface takes the form of an end of the shell which is folded round.

* * * * *